US007303428B2

(12) United States Patent
Ma

(10) Patent No.: US 7,303,428 B2
(45) Date of Patent: Dec. 4, 2007

(54) ELECTRICAL CONNECTOR ASSEMBLY WITH FASTENING MEANS

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/528,109

(22) Filed: Sep. 27, 2006

(65) Prior Publication Data

US 2007/0082514 A1 Apr. 12, 2007

(30) Foreign Application Priority Data

Sep. 28, 2005 (CN) ..... 2005 1 0094678

(51) Int. Cl.
*H01R 13/00* (2006.01)

(52) U.S. Cl. ..... 439/487

(58) Field of Classification Search ..... 439/487, 439/79; 361/709, 710, 719
See application file for complete search history.

(56) References Cited

U.S. PATENT DOCUMENTS 5,019,940 A * 5/1991 Clemens ..... 361/723
6,697,263 B2 * 2/2004 Szu ..... 361/816

* cited by examiner

*Primary Examiner*—Javaid H. Nasri
(74) *Attorney, Agent, or Firm*—Wei Te Chung

(57) ABSTRACT

An electrical connector assembly (100) includes an electrical connector (2) with a first plurality of holes (230) thereon, a heat sink (3) mounted onto the electrical connector and including a second plurality of holes (300) thereon, a substrate (4) mounted onto the electrical connector and including a third plurality of holes (400) thereon. The second plurality of holes and the third plurality of holes are aligned with and in communication with the first plurality of holes. A plurality of pin-like elements (1) is respectively insertable into the first plurality of holes, the second plurality of holes and the third plurality of holes so as to hold the heat sink, the electrical connector and the substrate together. Since the substrate is needed to define a single group of holes in correspondence with the pin-like elements, much more room is available on the substrate for active and passive electronic elements to be equipped therewith.

16 Claims, 9 Drawing Sheets

ELECTRICAL CONNECTOR ASSEMBLY WITH FASTENING MEANS

BACKGROUND OF THE INVENTION

1. Field of the Invention

The present invention relates to the art of electrical connectors, and more particularly to arrangements of fastening means for application to an electrical connector assembly.

2. Description of the Related Art

One conventional electrical connector assembly 100' is shown in FIGS. 8 and 9. The electrical connector assembly 100' comprises an electrical connector 2' defining a mating surface 21' and an opposite mounting surface 22', a heat sink 3' mounted onto the mating surface 21' of the electrical connector 2', and a substrate 4' mounted onto the mounting surface 22' of the electrical connector 2'. Normally the substrate 4' comprises holes including a first group of four small holes 41' and a second group of two large holes 43'. The electrical connector 2' defines four receiving holes 220' corresponding to the four small holes 41', while the heat sink 3' define another two receiving holes 30' for corresponding to the two large holes 43'. Fastening means, generally in forms of pins, are inserted into these holes of the heat sink 3', the electrical connector 2' and the substrate 4' in order to hold the heat sink 3', the electrical connector 2' and the substrate 4' together. More specifically, a first group of four small pin-like elements 5' are inserted through the receiving holes 220' of the electrical connector 2' into the holes 41' of the substrate 4' so as to assemble the electrical connector 2' onto the substrate 4'. A heat sink 3' is then mounted onto the sub-assembly including the electrical connector 2' and the substrate 4', and a second group of two large pin-like elements 1' are then inserted into the receiving holes 30' of the heat sink 3' and the large holes 43' of the substrate 4' to mount the heat sink 3' to the substrate 4'. As such, the heat sink 3' and the electrical connector 2' are securely held on the substrate 4' by the two groups of pin-like elements 1' and 5'. However, since two groups of pin-like elements, rather than a single group of pin-like element, are needed 1' and 5' to hold the electrical connector 2', the substrate 4' and the heat sink 3' together, the substrate 4' must define two groups of holes 41' and 43' for receiving these pin-like elements 1' and 5'. Additional group of holes 43' defined on the substrate 4' may take up a "real estate" of the substrate 4', thereby reducing available room for active and passive electronic components (not shown) to be equipped therewith. Therefore, there is a need to provide a new electrical connector assembly to resolve the above-mentioned shortcomings.

SUMMARY OF THE INVENTION

An electrical connector assembly according to an embodiment of the present invention includes an electrical connector defining a mating surface and an opposite mounting surface, a heat sink member mounted onto the mounting surface of the electrical connector, a substrate member mounted onto the mounting surface of the electrical connector and pin-like fastening means. The electrical connector includes a first plurality of holes thereon. The heat sink member includes a second plurality of holes extending from a mating side of the heat sink member, the mating side adapted to face the mating surface of the electrical connector. The substrate member includes a third plurality of holes extending from a mounting side of the substrate member, the mounting side adapted to face the mounting surface of the electrical connector. The second plurality of holes and the third plurality of holes are configured to be aligned with and in communication with the first plurality of holes. The pin-like fastening means includes a plurality of pin-like elements insertable into the first plurality of holes, the second plurality of holes and the third plurality of holes respectively so as to hold the heat sink member, the electrical connector and the substrate member together. As compared with the prior art, since the substrate member is needed to define a single group of holes in correspondence with the pin-like elements, much more room is available on the substrate member for active and passive electronic elements to be equipped therewith.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
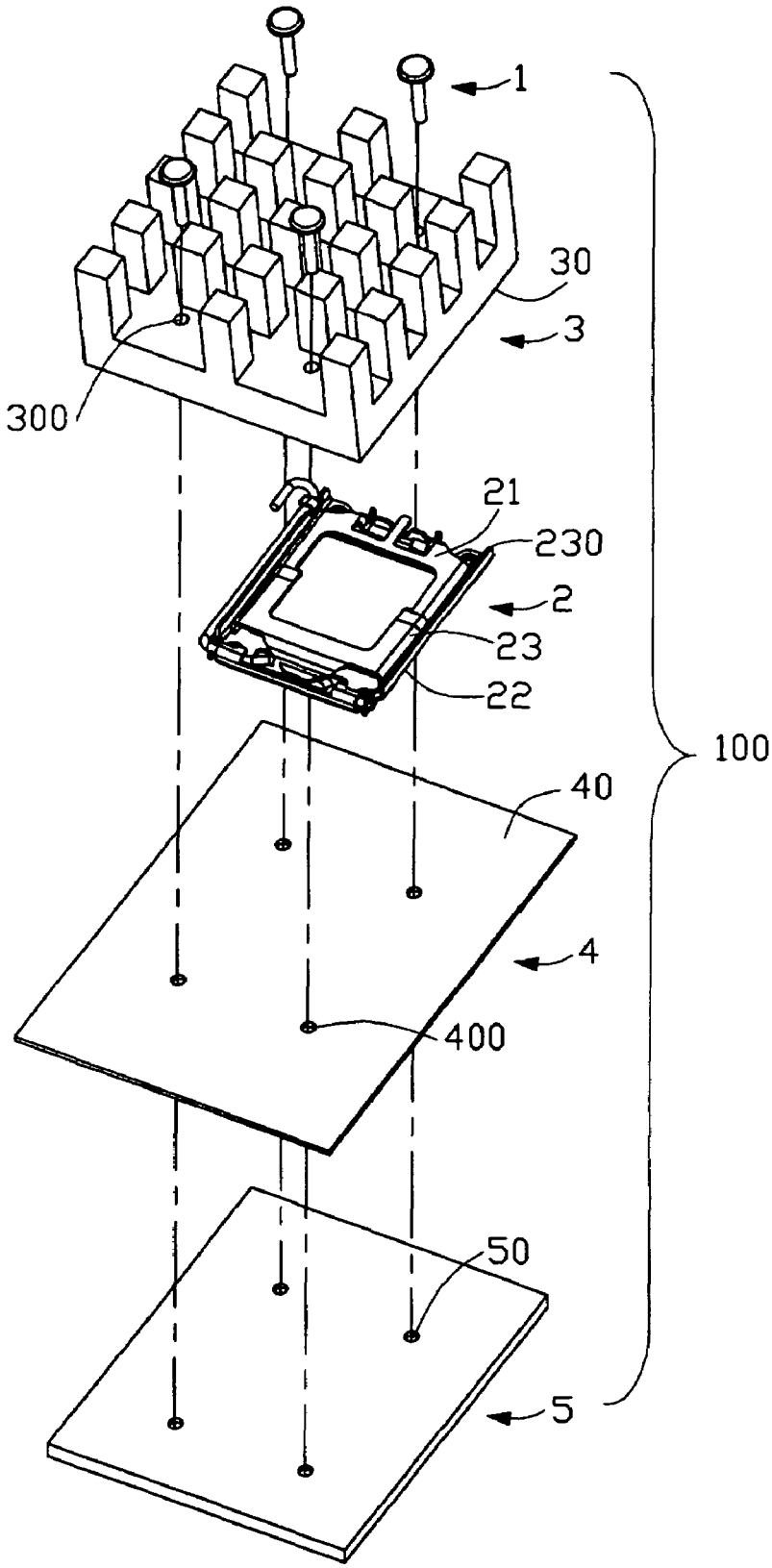
FIG. 1 is an exploded, perspective view of an electrical connector assembly according to a first embodiment of the present invention.
Figure 2:
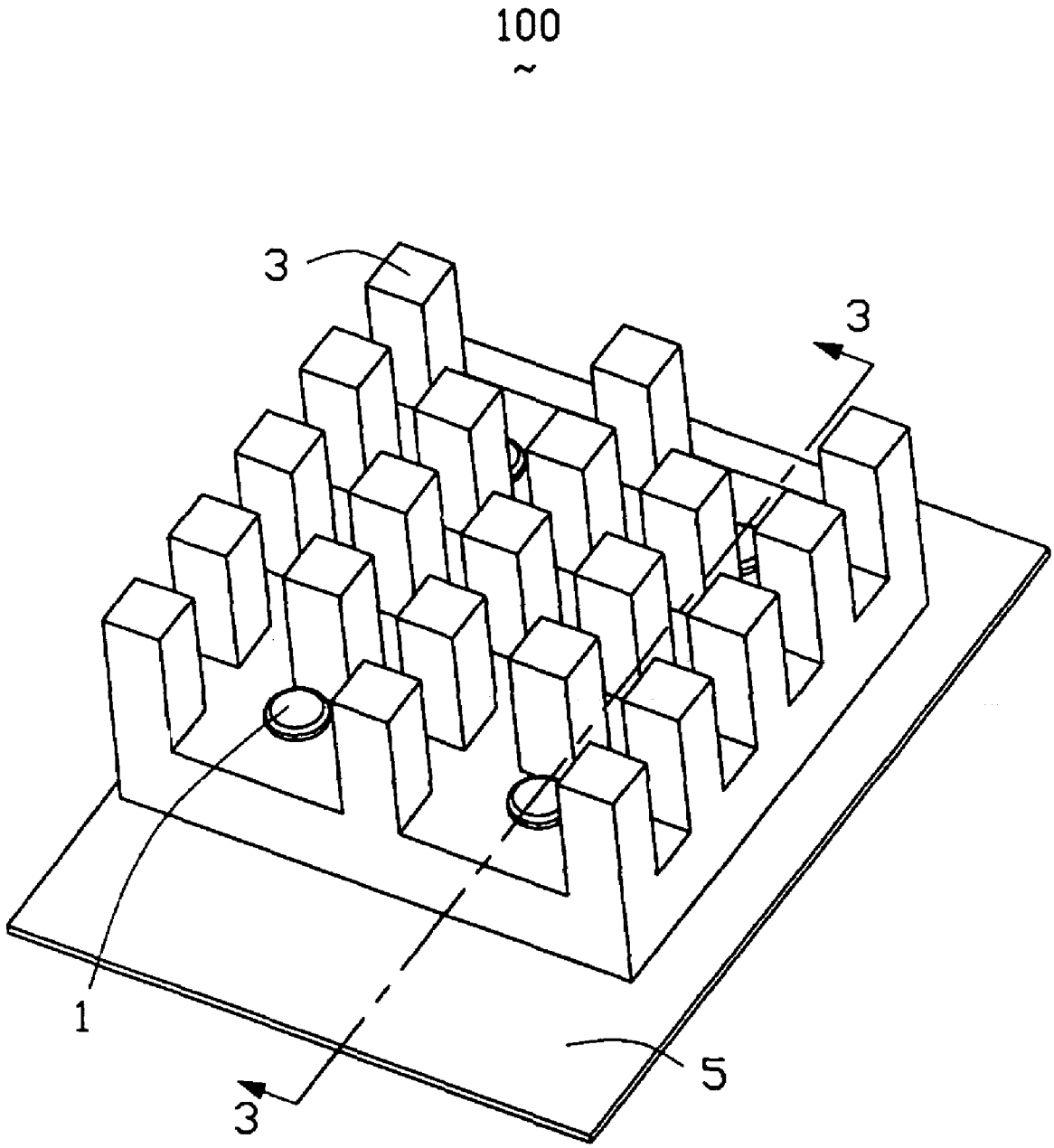
FIG. 2 is an assembled, perspective view of the electrical connector assembly of FIG. 1.
Figure 3:
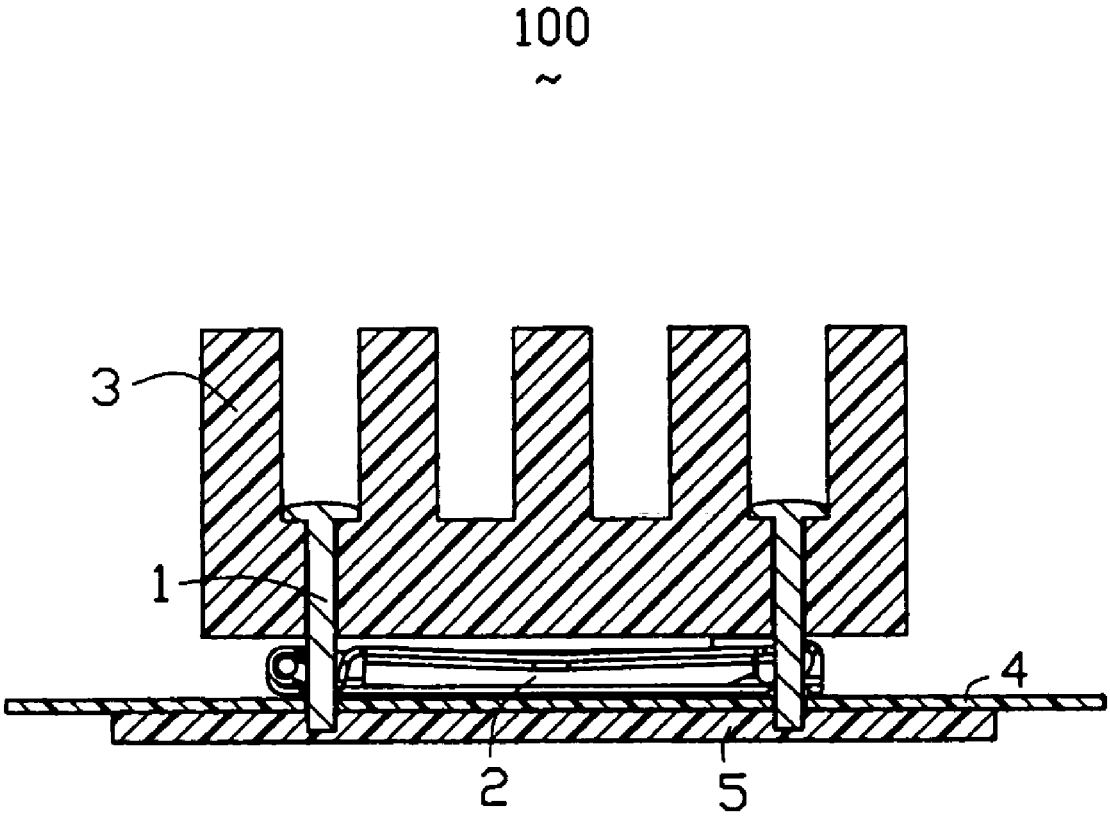
FIG. 3 is a cross sectional view of the electrical connector assembly taken along line 3-3 of FIG. 2.

Referring to FIGS. 1 to 3, an electrical connector assembly 100 according to a first embodiment of the present invention is shown. The electrical connector assembly 100 includes an electrical connector 2, a heat sink member 3, a substrate member 4, a back plate 5 and pin-like fastening means. The electrical connector 2 defines a mating surface 21 and an opposite mounting surface 22. The heat sink member 4 is mounted onto the mating surface 21 of the electrical connector 2, the substrate member 4 is assembled onto the mounting surface 22 of the electrical connector 2, and the back plate 5 is assembled onto the substrate member 4 disposed in opposite relationship with respect to the electrical connector 2.

The electrical connector 2 includes a first plurality of holes, generally including four holes 230. The four holes 230 are generally located on at least a portion of a periphery of the electrical connector 2. In this embodiment, the electrical connector 2 further includes a stiffening frame 23 attached to an insulative body of the electrical connector 2. The four holes 230 are respectively located at four corners of a periphery of the stiffening frame 23. The heat sink member 3 includes a second plurality of holes 300 extending from a mating side 30 of the heat sink member 3, which is adapted to face the mating surface 21 of the electrical connector 2. The substrate member 4 includes a third plurality of holes 400 extending from a mounting side 40 of the substrate member 4, which is adapted to face the mounting surface 22 of the electrical connector 2. The back plate 5 includes a fourth plurality of holes 50 thereon. The second plurality of holes 300, the third plurality of holes 400, and the fourth plurality of holes 50 are configured to be aligned with and in vertical communication with the first plurality of holes 230. The pin-like fastening means comprises a plurality of pin-like elements including four pin-like elements 1 in correspondence with the holes 230 of the electrical connector 2, the heat sink member 3 and the substrate member 4. These pin-like elements 1 are configured to have a height sufficient to be insertable into the first plurality of holes 230, the second plurality of holes 300 and the third plurality of holes 400 so as to hold the heat sink member 3, the electrical connector 2, the substrate member 4 and the back plate 5 together. As compared with the prior art, since the substrate member 4 is needed to define four holes 400, regarded as a single group of holes, in correspondence with the pin-like elements 1, much more room is available on the substrate member 4 for active and passive electronic elements (not shown) to be equipped therewith.

Referring to FIGS. 4 to 7, an electrical connector assembly 200 according to a second embodiment of the present invention is shown. The electrical connector assembly 200 is similar to the electrical connector assembly 100 of the first embodiment except for the pin-like elements. In this embodiment, each of the pin-like elements includes a two-part structure having an upper pin part 10 and a lower pin part 11. The lower pin part 11 defines a receptacle 110 at an upper portion thereof for receiving a lower end portion of the upper pin part 10 so as to have an unitary pin-like element with a height sufficient to hold a heat sink member 7, an electrical connector 6, a substrate member 8 and a back plate 9 together.

Figure 4:
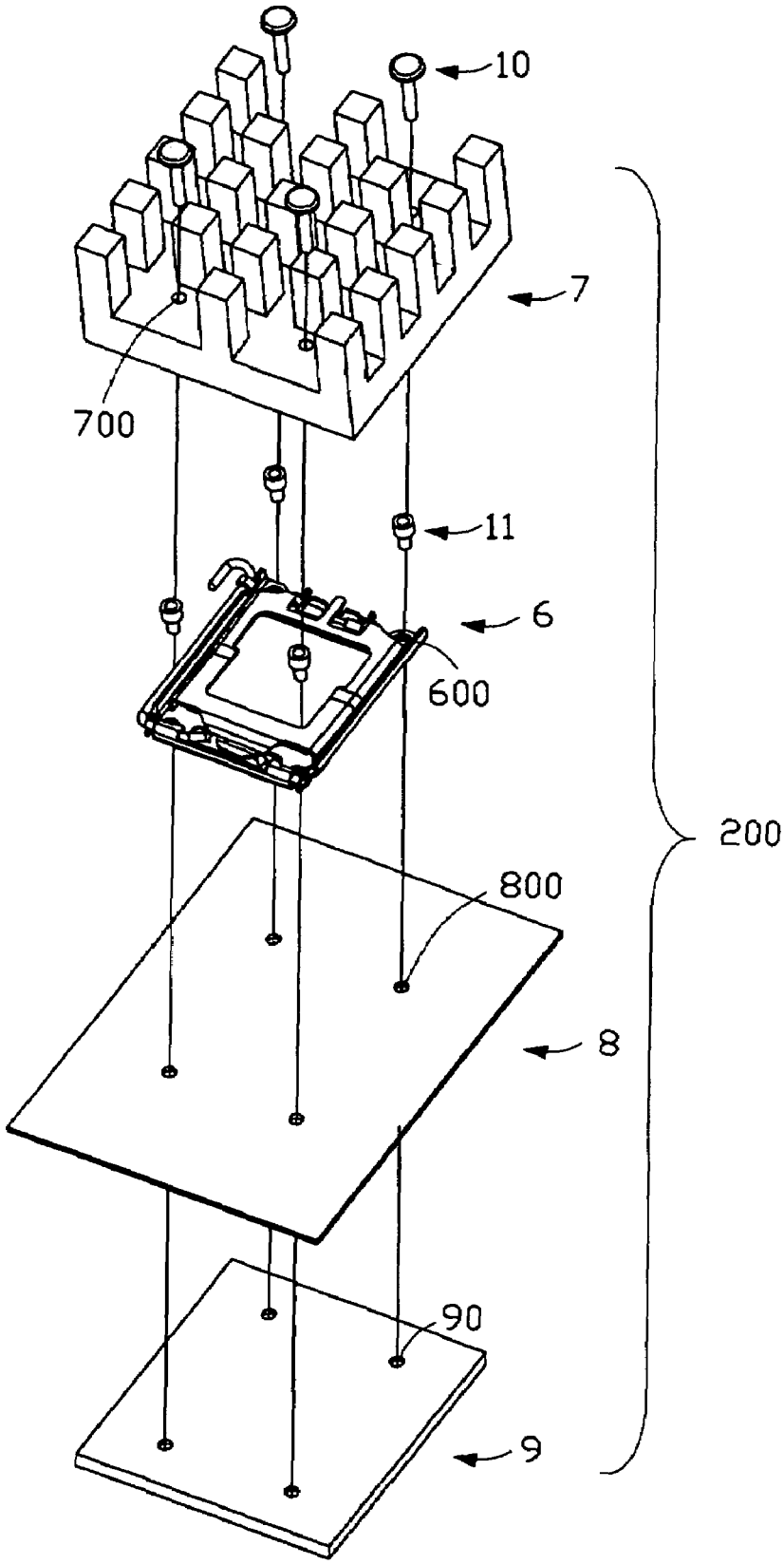
FIG. 4 is an exploded, perspective view of an electrical connector assembly according to a second embodiment of the present invention.
Figure 5:
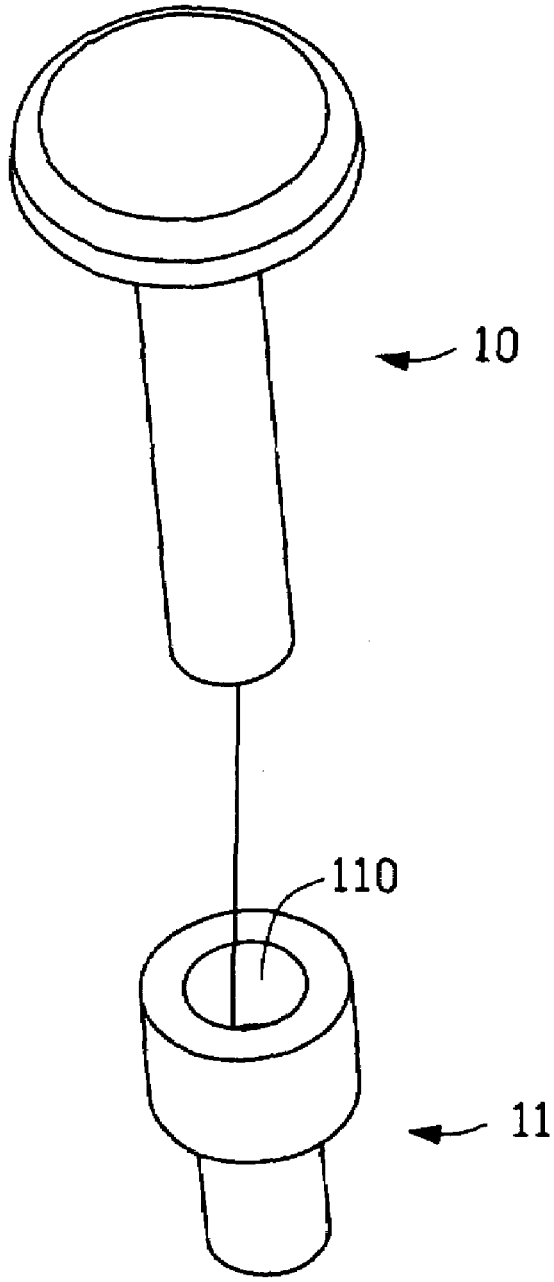
FIG. 5 is an enlarged view showing a two-part structure of a pin-like fastening member applicable to the electrical connector assembly of FIG. 4.
Figure 6:
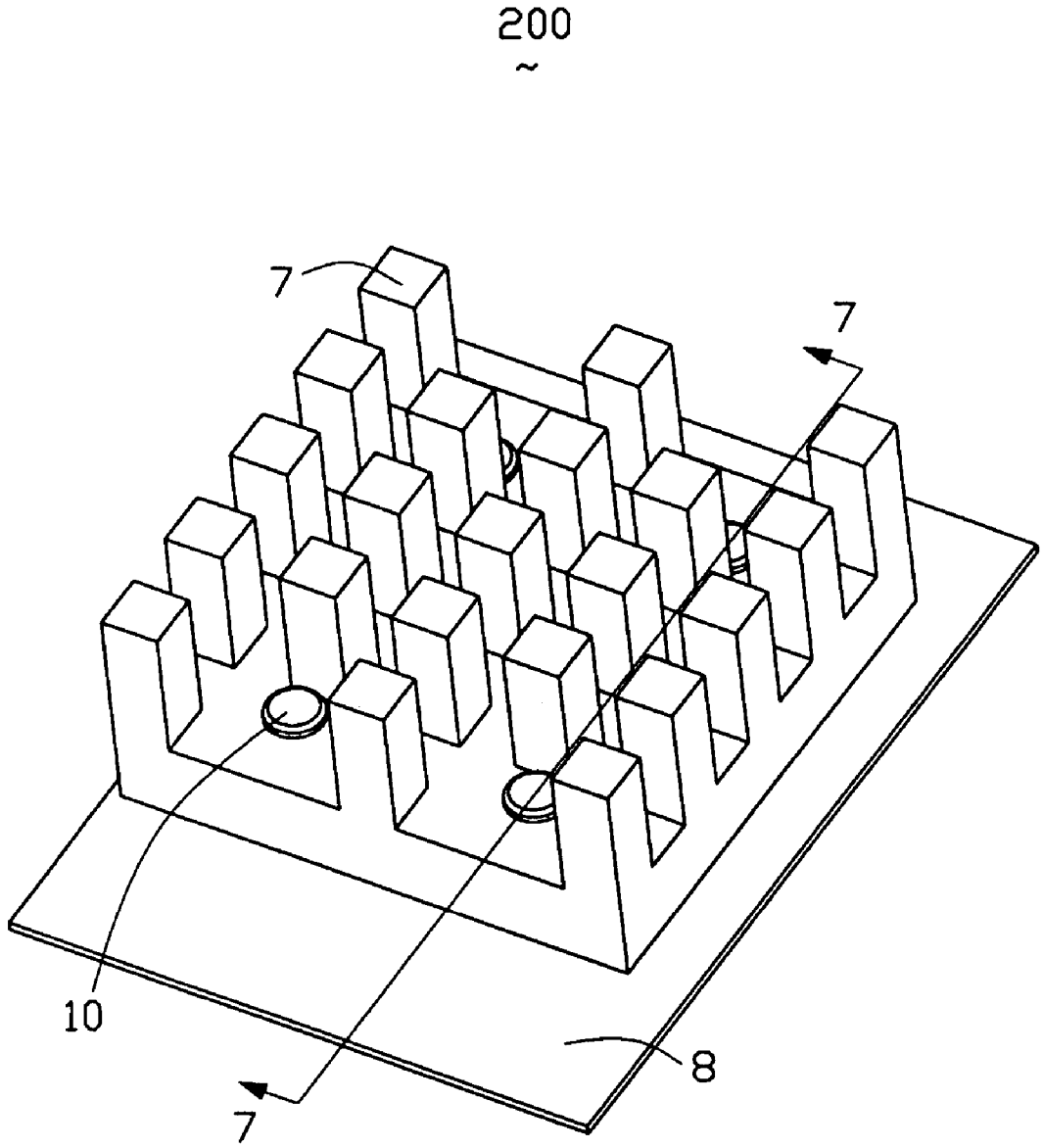
FIG. 6 is an assembled, perspective view of the electrical connector assembly of FIG. 4.
Figure 7:
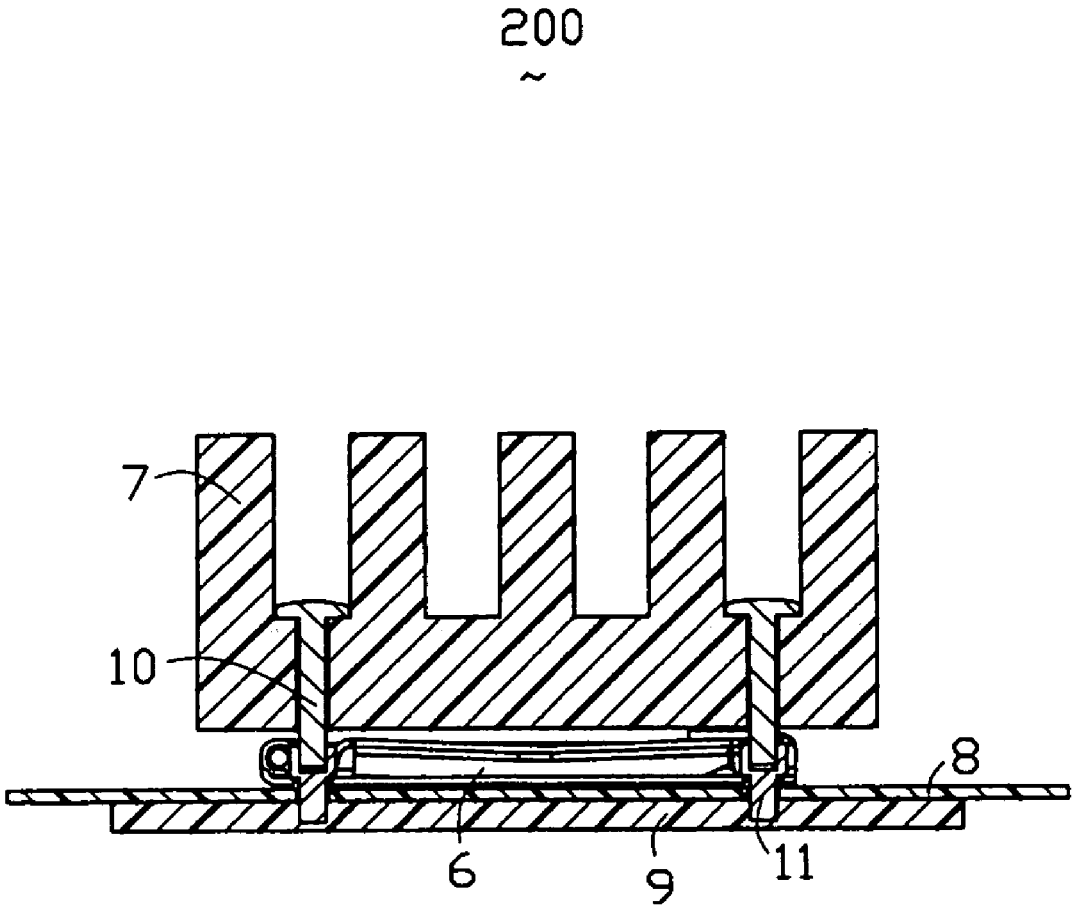
FIG. 7 is a cross sectional view of the electrical connector assembly taken along line 7-7 of FIG. 6.
Figure 8:
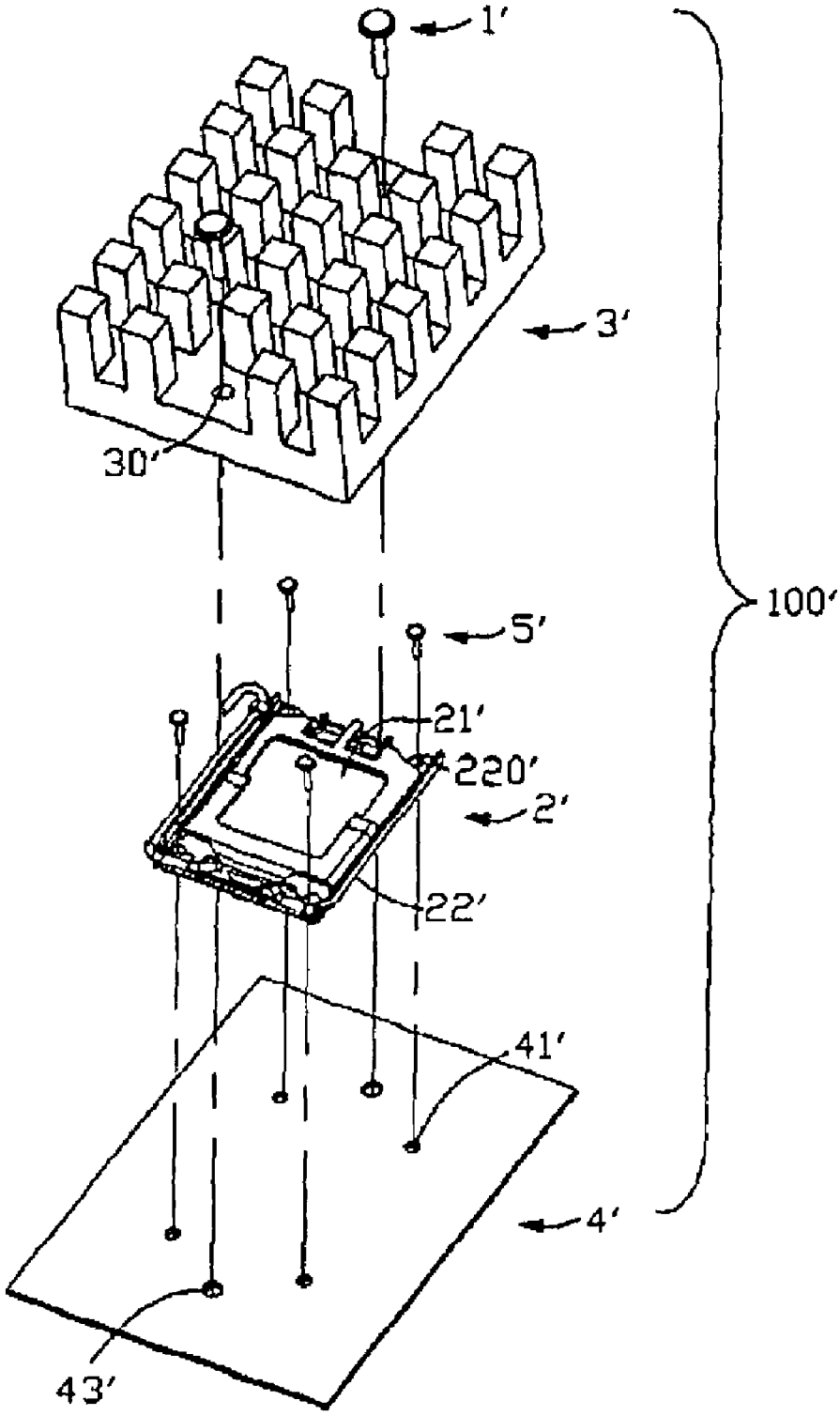
FIG. 8 (RELATED ART)
FIG. 8 is an exploded, perspective view of a conventional electrical connector assembly.
Figure 9:
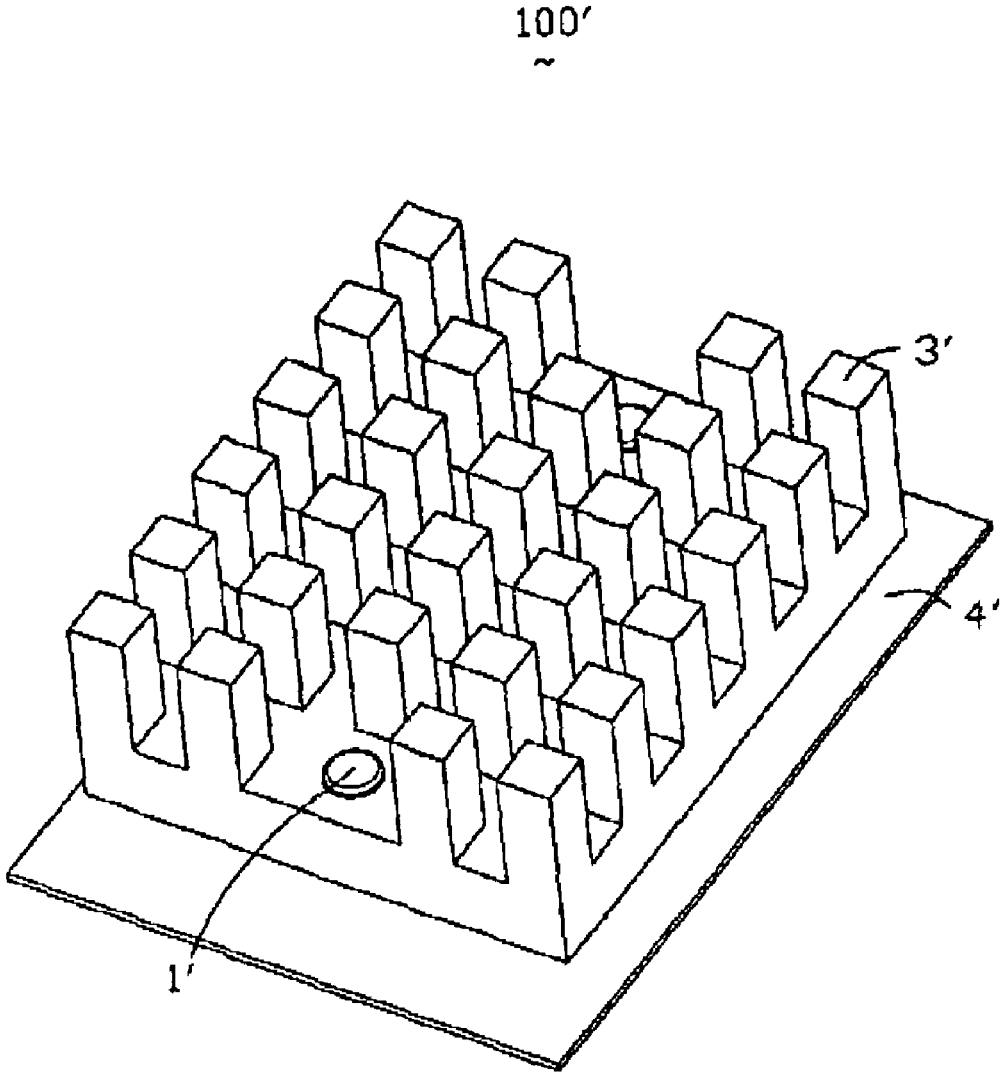
FIG. 9 (RELATED ART)
FIG. 9 is an assembled, perspective view of the electrical connector assembly of FIG. 8.

Referring to FIGS. 4 and 7, in assembly, the lower pin parts 11 of the pin-like elements are respectively inserted into a first plurality of holes 600, a third plurality of holes 800 and a fourth plurality of holes 90 to assemble the substrate member 8 and the back plate 9 with the electrical connector 6. The upper pin parts 10 of the pin-like elements are then inserted into the corresponding lower pin parts 11 through the second plurality of holes 700 of the heat sink member 7 so as to hold the sub-assembly including the electrical connector 6, the substrate member 8 and the back plate 9, and the heat sink member 7 together. As compared with the prior art, since the substrate member 8 is needed to define four holes 800, regarded as a single group of holes, in correspondence with the pin-like elements, much more room is available on the substrate member 8 for active and passive electronic elements to be equipped therewith.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly comprising:

an electrical connector defining a mating surface and an opposite mounting surface, the electrical connector including a first plurality of holes thereon;

a heat sink member mounted onto the mating surface of the electrical connector, the heat sink member including a second plurality of holes aligned with the first plurality of holes;

a substrate member facing the mounting surface of the electrical connector, the substrate member including a third plurality of holes aligned with the first plurality of holes; and a plurality of pin-like elements insertable into the first plurality of holes, the second plurality of holes and the third plurality of holes for holding the heat sink member, the electrical connector and the substrate member together; and each of the pin-like including a two-part structure having an upper pin part and a lower pin part, the upper pin part being received within the lower pin part; wherein the lower pin part is insertable into the electrical connector and the substrate member, and the upper pin part is insertable into the heat sink member with an end portion thereof received in the lower pin part;

wherein the lower pin part is located partially within the connector.

2. The electrical connector assembly as recited in claim 1, wherein the pin-like element is of a one-piece structure.

3. The electrical connector assembly as recited in claim 1, further comprising a back plate mounted onto an opposite mating side of the substrate member, the back plate including a fourth plurality of holes in alignment with the holes of the substrate member for the pin-like elements to be penetrated therethrough.

4. The electrical connector assembly as recited in claim 1, wherein the first plurality of holes is located on at least a portion of a periphery of the electrical connector.

5. The electrical connector assembly as recited in claim 4, wherein the first plurality of holes is located at respective corners of a peripheral portion of the electrical connector.

6. The electrical connector assembly as recited in claim 4, wherein the electrical connector includes a stiffener attached thereto, the first plurality of holes is located on at least a portion of a periphery of the stiffener.

7. An electrical connector assembly comprising:

a printed circuit board;

an electrical connector mounted upon the printed circuit board, and having a plurality of contacts electrically and mechanically connected to the printed circuit board, said connector defining a periphery thereof;

an electronic component seated upon and electrically connected to the connector;

a heat sink seated upon and intimately contacting the electronic component;

a first set of fastening devices located within the periphery and including a head downwardly seated upon and pressing against the connector, and fastening the connector to the printed circuit board in addition to said contacts; and a second set of fastening devices located within the periphery and fastening the heat sink and the connector together.

8. The assembly as claimed in claim 7, wherein said first set of fastening devices are directly fastened to the second set of fastening devices, respectively.

9. The assembly as claimed in claim 7, wherein the connector defines a first set of through holes, and the printed circuit board defines a second set of through hole in vertical alignment with the corresponding first set of through holes, respectively.

10. The assembly as claimed in claim 9, wherein the heat sink defines a third set of through holes in vertical alignment with the corresponding first set of through holes and the second set of through holes, respectively.

11. The assembly as claimed in claim 9, further including a back plate located under the printed circuit board opposite to the connector, wherein said back plate further defines another set of through holes in vertical alignment with the corresponding first set of through holes and the second set of through holes, respectively.

12. The assembly as claimed in claim 7, wherein said first set of fastening devices and said second set of fastening devices are vertically aligned with each other, respectively.

13. The assembly as claimed in claim 7, further including a back plate located under the printed circuit board opposite to the connector, wherein the first set of fastening devices are further fastened to said back plate.

14. An electrical connector assembly comprising:

a printed circuit board;

an electrical connector mounted upon the printed circuit board, and having a plurality of contacts electrically and mechanically connected to the printed circuit board, said connector defining a periphery thereof;

an electronic component seated upon and electrically connected to the connector;

a heat sink seated upon and intimately contacting the electronic component;

a fastening kit including a plurality of fastening subassemblies dispersed within the periphery, wherein each of said subassemblies extends downwardly along a vertical axis to fix the printed circuit board, the connector and the heat sink together; wherein each of said subassemblies includes a lower fastener having a head downwardly seated upon and pressing against the connector, and directly fastening the connector and the printed circuit board, and an upper fastener fastening the heat sink and the connector.

15. The assembly as claimed in claim 14, wherein fastening between the heat sink and the connector is performed by coupling said upper fastener and the lower fastener together.

16. The assembly as claimed in claim 14, wherein the upper fastener is a screw embedded within a plurality of upwardly extending fins for protection.

* * * * *